US006027049A

United States Patent [19]

Stier

[11] Patent Number: 6,027,049

[45] Date of Patent: Feb. 22, 2000

[54] FUEL-INJECTION VALVE, METHOD FOR PRODUCING A FUEL-INJECTION VALVE AND USE OF THE SAME

[75] Inventor: Hubert Stier, Schwieberdingen, Germany

[73] Assignee: Robert Bosch GmbH, Stuttgart, Germany

[21] Appl. No.: 09/180,312

[22] PCT Filed: Jan. 21, 1998

[86] PCT No.: PCT/DE98/00176

§ 371 Date: Nov. 5, 1998

§ 102(e) Date: Nov. 5, 1998

[87] PCT Pub. No.: WO98/42977

PCT Pub. Date: Oct. 1, 1998

[30] Foreign Application Priority Data

Mar. 26, 1997 [DE] Germany ..... 197 12 591

[51] Int. Cl.[7] ..... B05B 1/30

[52] U.S. Cl. ..... 239/585.1; 239/900; 251/129.15

[58] Field of Search ..... 239/585.1, 585.4, 239/585.5, 533.2, 533.6, 533.9, 533.15, 900; 251/129.18, 129.15, 129.17, 129.22; 335/255

[56] References Cited

U.S. PATENT DOCUMENTS

| | | | |
|---|---|---|---|
| 3,567,135 | 3/1971 | Gebert . | |
| 4,834,295 | 5/1989 | Cristiani et al. . | |
| 4,959,027 | 9/1990 | Muzslay . | |
| 5,044,563 | 9/1991 | Mesenich . | |
| 5,156,124 | 10/1992 | Sugimoto et al. . | |
| 5,394,850 | 3/1995 | Murphy et al. . | |
| 5,428,883 | 7/1995 | Stieglitz | 239/585.1 |
| 5,732,888 | 3/1998 | Maier et al. | 239/585.1 |
| 5,820,032 | 10/1998 | Reiter | 239/585.1 |
| 5,887,798 | 3/1999 | Ohta et al. | 239/585.1 |

FOREIGN PATENT DOCUMENTS

| | | |
|---|---|---|
| 0 690 224 | 1/1996 | European Pat. Off. . |
| 21 53 286 | 9/1972 | Germany . |
| 34 39 672 | 4/1986 | Germany . |
| 40 32 425 | 4/1991 | Germany . |
| 195 12 339 | 10/1996 | Germany . |

*Primary Examiner*—Andres Kashnikow
*Assistant Examiner*—Lisa Ann Douglas
*Attorney, Agent, or Firm*—Kenyon & Kenyon

[57] ABSTRACT

A fuel injection valve for fuel injection systems of internal combustion engines includes two preassembled independent assemblies. A functional part substantially has an electromagnetic circuit and a sealing valve, while a connector part is constituted principally by a hydraulic connector and an electrical connector. In the completely assembled injection valve, electrical connecting elements and hydraulic connecting elements of the two assemblies coact so as to guarantee a reliable electrical and hydraulic connection. The fuel injection valve is particularly suitable for use in fuel injection systems of mixture-compressing, spark-ignited internal combustion engines.

21 Claims, 4 Drawing Sheets

FUEL-INJECTION VALVE, METHOD FOR PRODUCING A FUEL-INJECTION VALVE AND USE OF THE SAME

BACKGROUND INFORMATION

U.S. Pat. No. 5,156,124 describes a fuel injection valve that is electromagnetically actuatable. For this purpose, the fuel injection valve has the usual components of an electromagnetic circuit, such as a magnet coil, an internal pole, and an external pole. This known injection valve is a so-called side-feed injection valve, in which fuel delivery is accomplished largely below the magnetic circuit. Proceeding from the magnet coil, contact pins project out from the fuel injection valve; these have plastic insert-molded around them over a certain length, and are embedded therein. The insert-molded plastic is applied at one end of the fuel injection valve and does not constitute an independent component of the injection valve. The same applies for the fuel injection valve described in German Patent Application No. 34 39 672. In this German Application, contact pins proceeding from the magnet coil project to an electrical connector plug which is made from plastic and partially surrounds the contact pins behind the magnet coil. The insert-molded plastic constituting the connector plug is molded onto the metal valve housing.

European Patent Application No. 0 690 224 describes a fuel injection valve which possesses a nozzle opening that, with the valve in the installed state, is already located in the interior of an intake conduit, so that spray discharge can be accomplished in largely direct fashion onto an intake valve of an internal combustion engine, avoiding any wall wetting. Corresponding spray directions can be achieved by the fact that the nozzle opening of the injection valve extends along an axis which has no parallelism with the axis of the injection valve. A comparable fuel injection valve is also described in German Patent Application No. 40 32 425.

SUMMARY OF THE INVENTION

The fuel injection valve according to the present invention, has the advantage that it can be easily and economically manufactured and installed. In addition, variations in the configuration of the fuel injection valve can very easily be undertaken. According to the present invention, this is achieved in that two assemblies of the fuel injection valve, a functional part and a connector part, are preassembled and adjusted separately from one another. In this context, the functional part substantially an electromagnetic circuit and a sealing valve that is constituted from a valve seat element and valve closure element. The electrical and hydraulic connections of the injection valve are provided, on the other hand, in the connector part. All the exemplary embodiments of the fuel injection valve possess the advantage of being economical to manufacture with very many variant configurations. Functional parts produced in large volumes, of substantially identical design (differences, for example, in the magnitude of the valve needle stroke or the number of turns in the magnet coil), can be connected to very many different connector parts, which differ, for example in size and shape, in the configuration of the electrical connector plug, in the embodiment of the lower end surface of the connector part, or in terms of their color, markings, labeling, or some other identification. The fundamental logistics for the manufacture of fuel injection valves are thus simplified.

The separation into two assemblies yields the advantage that all negative influences associated with the manufacture of the connector part that is largely made of plastic (high insert-molding pressures, application of heat) are kept away from the components of the functional part which perform the important valve functions. The relatively dirty insert-molding operation can advantageously be performed away from the assembly line for the functional part.

According to the present invention, the functional part, which performs all the important valve functions, can be very short. The advantageous result is simplified access to the components of the injection valve which require adjustment. The principal result is greatly shortened distances for the introduction of measurement arrangements, e.g. measurement sensors for measuring the stroke of the valve needle, or tools for adjusting the dynamic spray discharge volume at the adjusting sleeve. The introduction distances for such measurement or adjustment tools can be shortened, as compared to known injection valves, from approximately 60 mm to, for example, 10 to 20 mm. As a consequence, cycle times in the assembly line are greatly reduced, so that more injection valves than before can be adjusting in the same amount of time.

Advantageously, a large number of variations can be effected in the electrical connecting elements on the functional part and connector part. For example, it is possible at any time to configure the electrical connecting elements both on the functional part and on the connector part, either as plugs or as sockets or as a combination of the two possibilities.

It is additionally advantageous to shape a lower, downstream end surface of the connector part obliquely with respect to a longitudinal valve axis running through the connector part, so that in the completely assembled fuel injection valve, the longitudinal valve axes of the functional part and the connector part do not align with one another. Kinked or angled fuel injection valves can thereby be produced as desired. A fuel injection valve is arranged, for example, on the intake manifold of an internal combustion engine in such a way that the spray discharge region of the injection valve extends considerably into the intake manifold; much of the functional part can in fact be located in the intake manifold. Wetting of the walls of the intake manifold can easily be prevented by directed spray discharge onto one or more intake valves of the internal combustion engine because of the angled configuration of the injection valve, thus reducing fuel consumption and the exhaust gas emissions of the internal combustion engine.

DETAILED DESCRIPTION

Figure 1:
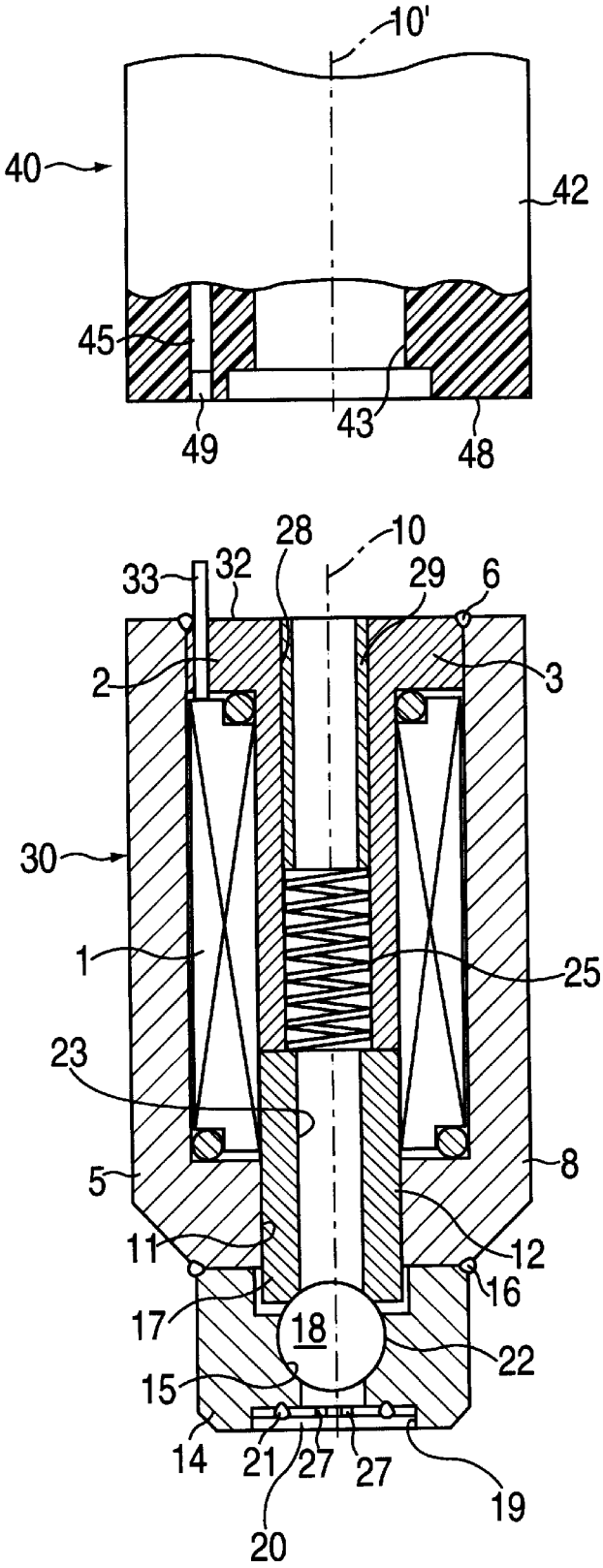
FIG. 1 shows a first exemplary embodiment of a fuel injection valve according to the present invention.

The electromagnetically actuatable valve according to the present invention depicted in exemplary and partially simplified fashion in FIG. 1, in the form of an injection valve for fuel injection systems of mixture-compressing, spark-ignited internal combustion engines, has a largely tubular core 2 which is surrounded by a magnet coil 1 and serves as the internal pole and partially as a fuel passage. Upstream from magnet coil 1, core 2 is of stepped configuration in the radial direction, so that core 2 partially envelops magnet coil 1 with its upper cover section 3, and makes possible a particularly compact design for the injection valve in the region of magnet coil 1. Magnet coil 1 is surrounded by an external, for example ferromagnetic valve shell 5 as the external pole, which completely surrounds magnet coil 1 in the circumferential direction and at its upper end is joined immovably to core 2, for example via a weld bead 6. To close the magnetic circuit, valve shell 5 is of stepped configuration at its lower end, thus forming a conductive section 8 which, like cover section 3 of core 2, axially delimits magnet coil 1 and constitutes the boundary of magnet coil region 1 toward the bottom or in the downstream direction. Conductive section 8 possesses an inner opening 11, running concentrically with a longitudinal valve axis 10, which serves as guide opening for a valve needle 12 that is axially movable along longitudinal valve axis 10.

Adjoining the lower conductive section 8 of valve shell 5 is a valve seat element 14 which has an immovable valve seat surface 15 as the valve seat. Valve seat element 14 is immovably joined to valve shell 5 by way of a second weld bead 16 produced, for example, using a laser. Magnet coil 1, conductive section 8 of valve shell 5, and valve seal element 14 up to valve seat surface 15 constitute a through opening in which valve needle 12, which is constituted by a tubular armature 17 and a spherical valve closure element 18, moves. Arranged at the downstream end face of valve seat element 14, for example in a depression 19, is a flat perforated spray disk 20, the immovable joining of valve seat element 14 and perforated spray disk 20 being accomplished, for example, by way of a circumferential sealed weld bead 21. At its downstream end facing perforated spray disk 20, tubular armature 17 is immovably joined, for example by welding, to valve closure element 18 (which is, for example, spherical); grooves, holes, or channels are provided in joining region 22 so that fuel flowing through armature 17 in an internal longitudinal orifice 23 can emerge outward and can flow along valve closure element 18 to valve seat surface 15.

Actuation of the injection valve is accomplished, in known fashion, electromagnetically. The electromagnetic circuit having magnet coil 1, inner core 2, outer valve shell 5, and armature 17 serves to move valve needle 12 axially and thus to open the injection valve against the spring force of a return spring 25 or to close it. With its end facing away from valve closure element 18, armature 17 is directed toward core 2.

The spherical valve closure element 18 coacts with valve seat surface 15, which tapers in truncated conical fashion in the flow direction, of valve seat element 14 and is configured axially downstream from a guide opening in valve seat element 14. Perforated spray disk 20 possesses at least one, for example four spray discharge openings 27 shaped by electrodischarge machining or punching.

The insertion depth of core 2 in the injection valve is critical for, to among other things, the stroke of valve needle 12. In this context, the one end position of valve needle 12, when magnet coil 1 is not energized, is defined by contact of valve closure element 18 against valve seat surface 15 of valve seat element 14, while the other end position of valve needle 12, when magnet coil 1 is energized, results from contact of armature 17 against the downstream core end. The stroke is adjusted by an axial displacement of core 2, which is subsequently joined immovably to valve shell 5 in accordance with the desired position, laser welding being desirable for achieving weld bead 6.

In addition to return spring 25, an adjusting sleeve 29 is inserted into a flow orifice 28 of core 2 which runs concentrically with longitudinal valve axis 10 and serves to deliver fuel toward valve seat surface 15. Adjusting sleeve 29 is used to adjust the spring preload of return spring 25 which rests against adjusting sleeve 29 and in turn braces at its opposite end against armature 17; an adjustment of the dynamic spray discharge volume is also accomplished with adjusting sleeve 29.

The injection valve described above point is characterized by its particularly compact design, resulting in a very small, manageable injection valve whose valve shell 5 has, for example, an outside diameter of only approximately 11 mm. Individual components are depicted in simplified fashion; the injection valve includes, a completely functioning magnetic circuit whose design principle is described for conventional electromagnetically actuatable injection valves (German Patent Application No. 34 39 672 or German Patent Application No. 195 12 339).

These previously described components constitute an independent preassembled assembly which hereinafter will be called functional part 30. Functional part 30 thus includes substantially the electromagnetic circuit 1, 2, 5 as well as a sealing valve (valve closure element 18, valve seat element 14) with a subsequent spray conditioning element (perforated spray disk 20). The completely adjusted and assembled functional part 30 has, for example, a flat upper end surface 32 beyond which, for example, two contact pins 33 project. By way of electrical contact pins 33, which serve as electrical connecting elements, electrical contact is made to magnet coil 1 and it is thereby energized.

A second assembly, which hereinafter will be referred to as the connector part 40, is manufactured entirely irrespective of functional part 30. The independent and preassembled connector part 40 is shown only symbolically in FIG. 1; FIG. 3 shows, in a detailed characterization, an exemplary embodiment of a connector part 40 that can be transferred to the shown connector parts 40 of FIGS. 1 and 2. Connector part 40 includes the electrical and hydraulic connections of the fuel injection valve. Connector part 40, embodied largely as a plastic part, therefore possesses a tubular base element 42 which serves as a fuel inlet fitting. A fuel filter 44 is inserted or pressed into a flow orifice 43, running concentrically with a longitudinal connector part axis 10', of fuel inlet fitting (or tubular base element) 42, through which fuel flows out axially from the inflow end of the fuel injection valve (FIG. 3). Fuel filter 44 projects into flow orifice 43 of fuel inlet fitting 42 at its inlet end, and filters out those fuel constituents which, because of their size, might cause clogging or damage in the injection valve. In this context, flow orifice 43 can have, for example, multiple steps over its axial length.

When the fuel injection valve is completely assembled, a hydraulic connection between connector part 40 and functional part 30 is achieved in that flow orifices 43 and 28 of the two assemblies are brought together so as to ensure an unimpeded flow of fuel. For example, end surfaces 48 and 32 of connector part 40 and functional part 30 then lie directly against one another and are joined immovably to one another. Sealing elements can, for example, be provided in the joining region for reliable sealing.

Also provided in connector part 40 are two electrical contact elements 45 which are insert-molded during the plastic injection-molding process of base element 42 and thereafter are present in embedded fashion in the plastic. Also part of base element 42, which is made of plastic and serves largely as the fuel inlet fitting, is an electrical connector plug 46 that is concurrently injection-molded on (FIG. 3). Electrical contact elements 45 terminate at their one end as exposed contact pins 47 of electrical connector plug 46, which can be connected to a corresponding electrical connector element (not shown), for example a contact strip, for complete electrical contacting of the injection valve. At their end opposite connector plug 46, contact elements 45 extend as far as a lower end surface 48 of connector part 40, and there constitute an electrical connecting element 49 that can be configured, for example, in socket fashion. When the fuel injection valve is completely assembled, electrical connecting elements 33 and 49 coact in such a way that a secure electrical connection results, contact pins 33 engaging, for example, into socket-shaped connecting elements 49 on connector part 40. By way of electrical connector plug 46 and electrical connecting region 33, 49, electrical contact is therefore made to magnet coil 1 and it is thus energized.

Figure 2:
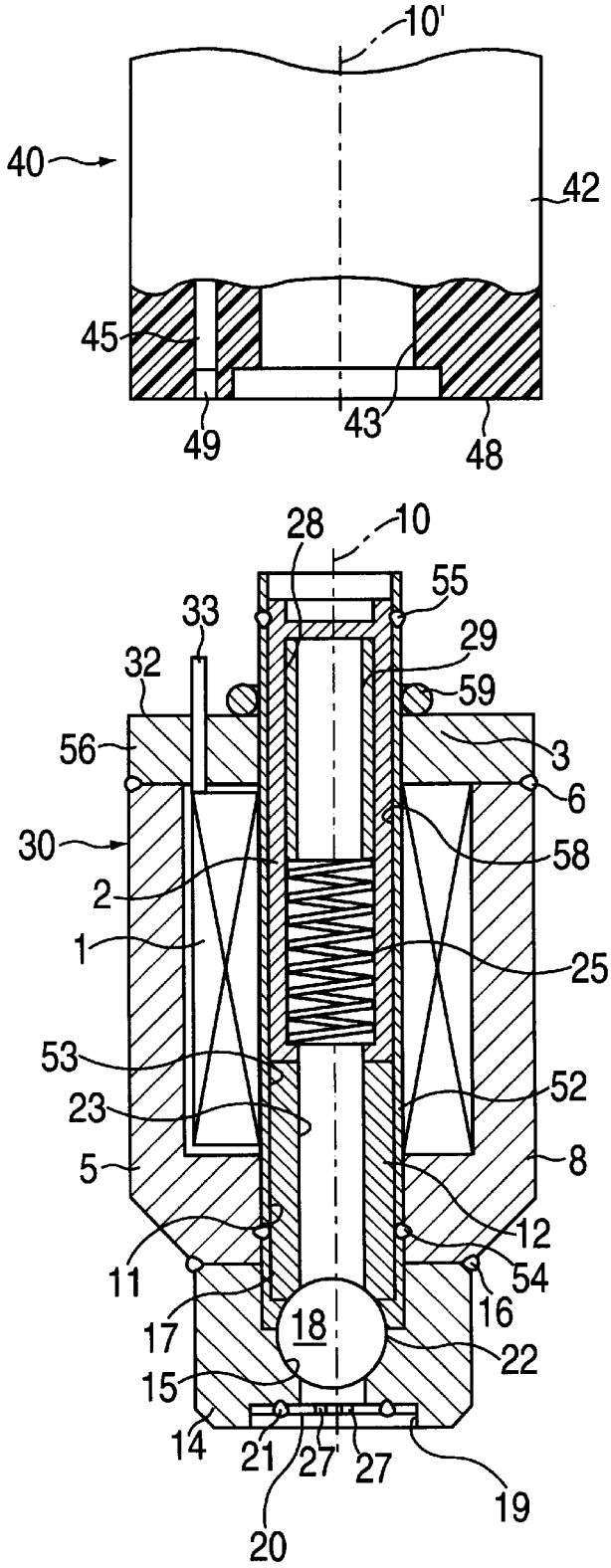
FIG. 2 shows a second exemplary embodiment of the fuel injection valve.
Figure 3:
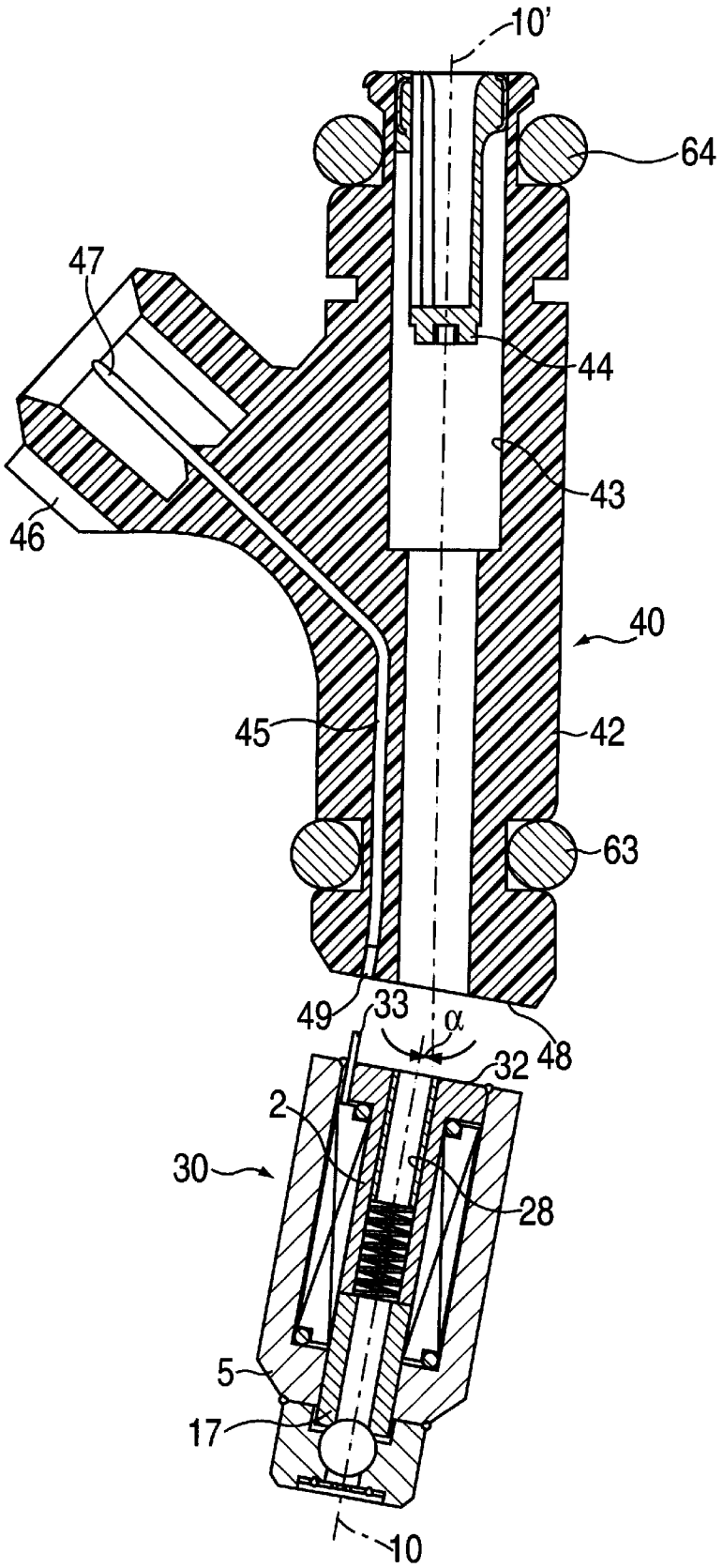
FIG. 3 shows a third exemplary embodiment of the fuel injection valve.

FIG. 2 shows a second exemplary embodiment of a partially depicted fuel injection valve. Components which are unchanged from or function in the same way as in the exemplary embodiment depicted in FIG. 1 are labeled with the same reference characters. The fuel injection valve of FIG. 2 corresponds substantially to the fuel injection valve of FIG. 1, and only the portions of the magnet circuit which differ will therefore be explained in detail below. An elongated ferrite sleeve 52, which possesses at least in the region of armature 17 an inner opening 53 that is dimensionally accurate in terms of inside diameter, is provided in functional part 30 to guide valve needle 12 and, especially, armature 17. Viewed in the downstream direction, sleeve 52 terminates, for example, in the region of conductive section 8 of valve shell 5, to which it is immovably joined, for example via a weld bead 54. Also introduced into inner opening 53 of sleeve 52, in addition to the axially movable valve needle 12, is core 2, which once again, when stroke adjustment is complete, is joined immovably to the valve housing, in this specific case to sleeve 52 by way of an upper weld bead 55. In addition to guiding armature 17 and receiving core 2, sleeve 52 also performs a sealing function, so that in the exemplary embodiment depicted in FIG. 2, a dry magnet coil 1 is present. This is also achieved by the fact that, in place of cover section 3 of core 2, a disk-shaped cover element 56 covers magnet coil 1 on its end facing connector part 40. Cover element 56 resting on valve shell 5 is immovably joined to valve shell 5 by weld bead 6. An inner orifice 58 in cover element 56 allows sleeve 52 and thus core 2 as well to be configured in elongated fashion, so that both pass through orifice 58 and project outward beyond upper end surface 32 toward connector part 40, upper end surface 32 being defined by cover element 56. When connector part 40 is installed on functional part 30, the projecting part of core 2 and of sleeve 52 can project into flow orifice 43 of connector part 40 in order to enhance the stability of the connection. Provided in the joining region of the two assemblies 30 and 40 is, for example, a sealing ring 59 which rests on end surface 32 of cover element 56 and surrounds sleeve 52.

FIG. 3 shows the two independent and already preassembled assemblies—functional part 30 and connector part 40—prior to final assembly of the fuel injection valve. Connector part 40 is formed by a plastic base element constituting fuel inlet fitting 42, on which electrical connector plug 46 is directly and concurrently shaped. Electrical connector plug 46 is concurrently injection-molded onto fuel inlet fitting 42 during the plastic injection-molding process used to manufacture connector part 40. The continuous, for example stepped flow orifice 43, into whose inlet end fuel filter 44 is introduced, extends along longitudinal connector part axis 10' in fuel inlet fitting 42. Flow orifice 43 terminates at the lower, downstream end surface 48 of connector part 40; in the exemplary embodiment depicted in FIG. 3, this end surface 48 extends in non-perpendicular fashion, i.e. obliquely with respect to longitudinal connector part axis 10'. Functional part 30 corresponds to functional part 30 35 already depicted in FIG. 1. Functional part 30 also extends along a longitudinal valve axis 10; in particular, core 2, valve shell 5, and armature 17 are configured concentrically with longitudinal valve axis 10. Toward connector part 40, functional part 30 terminates at a top, upstream end surface 32. When the fuel injection valve is in the assembled state, the two end surfaces 32 and 48 of functional part 30 and connector part 40 rest against one another in such a way that electrical connecting elements 33 and 49, and hydraulic connecting elements 28 and 43, coact.

Figure 4:
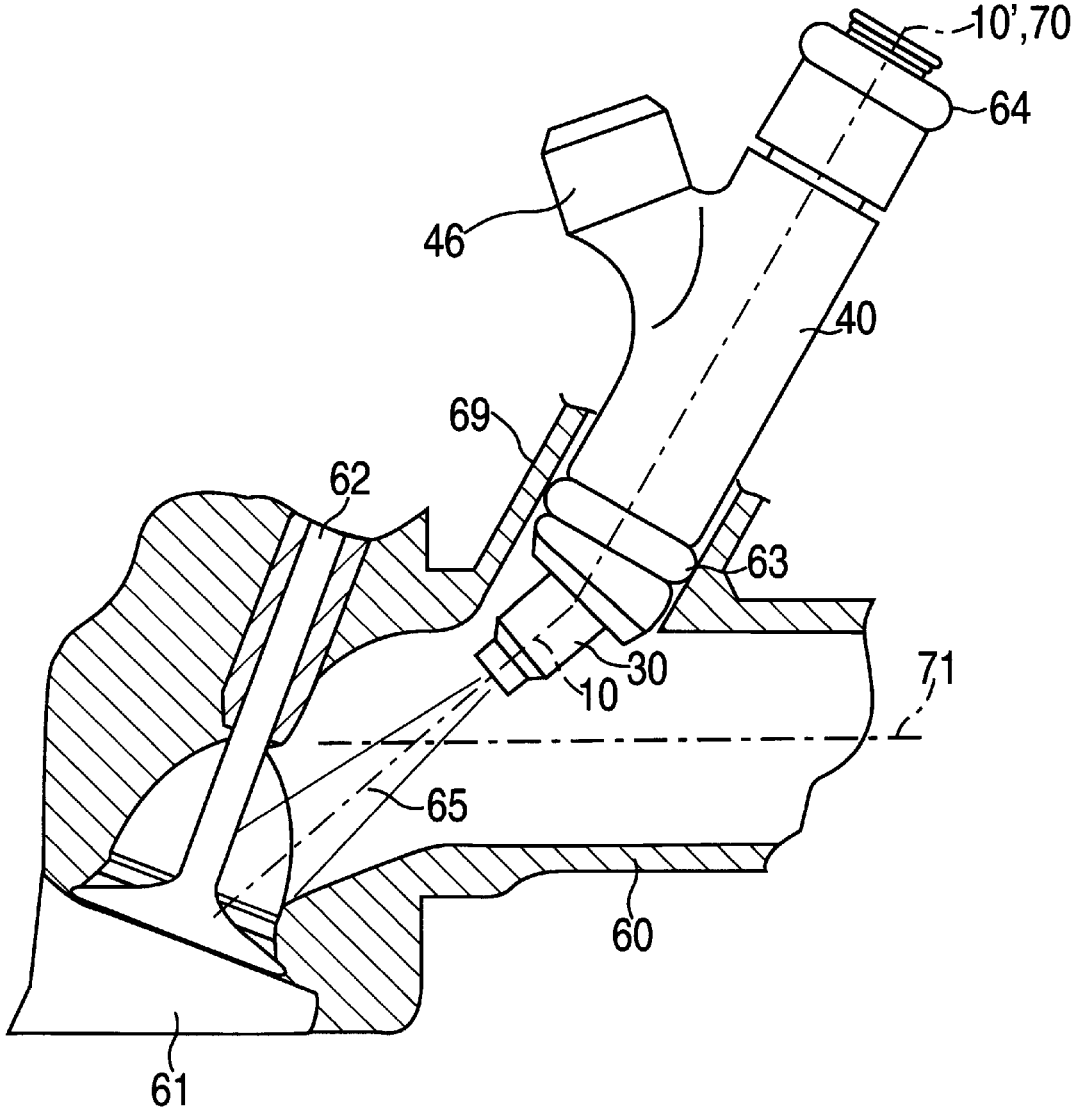
FIG. 4 shows an exemplary implementation for mounting the fuel injection valve illustrated in FIG. 3 on an internal combustion engine.

Since end surface 48 of connector part 40 runs obliquely with respect to longitudinal connector part axis 10', but end surface 32 of functional part 30 runs perpendicular to longitudinal valve axis 10, the result is a kinked or angled fuel injection valve in which the two longitudinal axes 10 and 10' run at an angle a to one another and thus do not align with one another. Another exemplary embodiment of an angled fuel injection valve is shown in FIG. 4. With a fuel injection arrangement of this kind, the fuel injection valve is arranged in a valve receptacle 69 on an intake manifold 60 which leads to a combustion chamber 61 of the internal combustion engine. Valve receptacle 69 extends along a longitudinal receptacle axis 70. Advantageously, longitudinal receptacle axis 70 extends in a different direction from longitudinal valve axis 10 of functional part 30.

The fuel injection valve is located directly in front of at least one intake valve 62 of combustion chamber 61. Intake air for the internal combustion engine is made available via intake manifold 60, which has, for example, a circular cross section and extends along a longitudinal intake manifold axis 71, the air volume being controlled via a throttling member (not depicted) upstream from the fuel injection valve in intake manifold 60. The fuel injection valve is mounted and aligned on intake manifold 60 in such a way that the fuel being sprayed out strikes substantially directly onto intake valve 62 with a fuel stream 65, and not onto the walls of intake manifold 60 or of the cylinder head of the internal combustion engine in which intake valve 62 is arranged.

Accurately targeted spraying of fuel onto intake valve 62, without wetting the walls, is achieved in particular by the two-part configuration of the fuel injection valve; the spray discharge angle can be adjusted quite precisely via the inclination of end surface 48 on connector part 40. The angling of functional part 30 with respect to connector part 40 means that the spray geometry can be configured much more flexibly as compared with known fuel injection valves. The fuel injection valve can be provided on intake manifold 60 as a so-called extended tip injector, which means that the spray discharge point of the injection valve is set forward into intake manifold 60. This can in fact be carried to the point that functional part 30 is located largely within intake manifold 60, so that in fact the electromagnetic circuit 1, 2, 5 is largely set forward into intake manifold 60. The fuel injection valve can be installed in valve receptacle 69 in such a way that the extended longitudinal valve axis 10 of functional part 30 either does or does not intersect longitudinal intake manifold axis 71, so that in the latter case the two aforesaid longitudinal axes 10 and 71 are located askew with respect to one another (usable, for example, for an unusual asymmetrical cylinder head configuration). Sealing rings 63 and 64, for example O-rings, provide effective sealing between the fuel injection valve and valve receptacle 69 which receives it on intake manifold 60.

After corresponding preassembly, the two assemblies—functional part 30 and connector part 40—are immovably joined to one another in a final process step. For this purpose, functional part 30 and connector part 40 are brought together in such a way that end surfaces 32 and 48 are resting against one another, and an electrical and hydraulic connection between the two assemblies 30, 40 is performed. Adhesive bonding, ultrasonic welding, or crimping are particularly suitable as methods for joining the two assemblies 30 and 40. In the case of adhesive bonding, particular care must be taken that the adhesive join has sufficient strength in tension. In order to accomplish a join by ultrasonic welding, a plastic region, which can be concurrently shaped, for example, during the insert molding of magnet coil 1, should be provided on functional part 30 in the region of upper end surface 32.

Alongside the various joining methods that can be used, various possibilities for producing the electrical and hydraulic connection can also be envisaged. Two possibilities for hydraulically connecting functional part 30 and connector part 40 are already evident from FIGS. 1 and 2. On the one hand, flow orifices 28 and 43 can be butt-joined to one another (FIG. 1); on the other hand, flow orifices 28 and 43 can engage into one another with a partial overlap (FIG. 2). Electrical contacting can be accomplished, for example, by the fact that two contact pins 33 of functional part 30 engage into two contact sockets 49 of connector part 40. It is of course also possible, however, to provide electrical connecting elements 49 on connector part 40 in pin form, while electrical connecting elements 33 of functional part 30 would then be embodied in socket fashion. Another possibility is to configure, near each of the end surfaces 32 and 48, respective plug-like and socket-like connecting elements 33, 49 which then mutually coact with one another. Electrical contacting can also, however, be achieved, for example, with the CIN::APSE® technology, in which gold-coated molybdenum wires are configured in agglomerated fashion as a button contact. These solderless connecting technologies allow the production of extremely reliable electrical connections which are entirely free of mechanical resonances.

All the exemplary embodiments of the fuel injection valves that have been described possess the advantage that they can be manufactured economically with very many variant configurations. Functional parts 30 produced in largely identical fashion in large volumes can be joined with very many different connector parts 40 which differ, for example, in terms of size, the configuration of electrical connector plug 46, or the embodiment of end surface 48. The fundamental logistics for the production of fuel injection valves are thus simplified.

What is claimed is:

1. A fuel injection valve for a fuel injection system of an internal combustion engine, comprising:

a preassembled functional part including:

an electromagnetic circuit including a magnet coil, an internal pole and an external pole, a sealing valve including a valve seat element and a valve needle, the valve needle including a valve closure element, a plurality of first electrical connecting elements, and a plurality of first hydraulic connecting elements;

a preassembled connector part including:

an electrical connector, a hydraulic connector, a plurality of second electrical connecting elements, and a plurality of second hydraulic connecting elements; and a valve seat situated on the valve seat element, wherein the valve needle moves in the electromagnetic circuit and cooperates with the valve seat, wherein the preassembled functional part and the preassembled connector part are independent from one another and are immovably joined to one another, and wherein a cooperation between the first and second electrical connecting elements and the first and second hydraulic connecting elements provides a reliable electrical and hydraulic connection between the preassembled functional part and the preassembled connector part.

2. The fuel injection valve according to claim 1, wherein the preassembled connector part is a plastic element which forms a fuel inlet fitting, the fuel inlet fitting having a continuous flow orifice, and wherein the electrical connector includes an electrical connector plug shaped on the fuel inlet fitting.

3. The fuel injection valve according to claim 2, wherein the electrical connector includes at least two contact elements extending from the electrical connector plug and through the preassembled connector part to the second electrical connecting elements.

4. The fuel injection valve according to claim 2, wherein the second electrical connecting elements are situated substantially near a downstream end surface of the preassembled connector part and a downstream end of the continuous flow orifice.

5. The fuel injection valve according to claim 4, further comprising:

contact pins extending from the magnet coil to the first electrical connecting elements at an upstream end surface of the preassembled functional part.

6. The fuel injection valve according to claim 5, wherein, when the fuel injection valve is assembled, the downstream end surface of the preassembled connector part and the upstream end surface of the preassembled functional part rest against one another such that the first and second electrical connecting elements and the first and second hydraulic connecting elements cooperate with one another.

7. The fuel injection valve according to claim 6, wherein the electromagnetic circuit further includes a core, and wherein the core projects into an inner continuous flow orifice of the preassembled connector part when the fuel injection valve is assembled.

8. The fuel injection valve according to claim 1, wherein the second electrical connecting elements have at least one of a plug-like shape and a socket-like shape.

9. The fuel injection valve according to claim 1, wherein the electromagnetic circuit further includes a core having an inner continuous flow orifice, the inner continuous flow orifice providing a fuel passage in a direction of the sealing valve.

10. The fuel injection valve according to claim 1, further comprising:

contact pins extending from the magnet coil to the first electrical connecting elements at an upstream end surface of the preassembled functional part.

11. The fuel injection valve according to claim 1, wherein the first electrical connecting elements have at least one of a plug-like shape and a socket-like shape.

12. The fuel injection valve according to claim 1, wherein the first electrical connecting elements include two contact pins, and the second electrical connecting elements include two contact sockets.

13. The fuel injection valve according to claim 1, wherein the preassembled connector part extends along a longitudinal connector part axis, and the preassembled functional part extends along a longitudinal valve axis, and wherein the longitudinal connector part axis does not align with the longitudinal valve axis.

14. The fuel injection valve according to claim 13, wherein the preassembled connector part has a downstream end surface extending obliquely with respect to the longitudinal connector part axis.

15. The fuel injection valve according to claim 1, wherein the internal combustion engine includes at least one intake manifold and a valve receptacle on the at least one intake manifold, the valve receptacle extending along a longitudinal receptacle axis, and wherein a longitudinal valve axis of the preassembled functional part extends in a direction which is different from a direction of the longitudinal receptacle axis.

16. The fuel injection valve according to claim 15, wherein the at least one intake manifold has a longitudinal manifold axis which is not intersected by the longitudinal valve axis.

17. A method for manufacturing a fuel injection valve for a fuel injection system of an internal combustion engine, comprising the steps of:

manufacturing and preassembling a functional part which includes:

an electromagnetic circuit having a magnet coil, an internal pole and an external pole, a sealing valve having a valve seat element and a valve needle, the valve needle including a valve closure element, a plurality of first electrical connecting elements, and a plurality of first hydraulic connecting elements;

manufacturing and preassembling a connector part, independent from the functional part, which includes:

an electrical connector, a hydraulic connector, a plurality of second electrical connecting elements, and a plurality of second hydraulic connecting elements;

arranging a valve seat on the valve seat element, the valve needle moving in the electromagnetic circuit and cooperating with the valve seat; and immovably joining the functional part and the connector part to form an electrical and hydraulic connection between the functional part and the connector part.

18. The method according to claim 17, wherein the connector part is manufactured using a plastic injection molding process, the connector part including a fuel inlet fitting which has a continuous flow orifice, and further comprising the step of:

shaping an electrical connector plug of the electrical connector on the fuel inlet fitting.

19. The method according to claim 17, wherein the joining step includes the substep of adhesive bonding one of the functional and connector parts to another one of the functional and connector parts.

20. The method according to claim 17, wherein the joining step includes the substep of ultrasonic welding one of the functional and connector parts to another one of the functional and connector parts.

21. The method according to claim 17, wherein the joining step includes the substep of crimping one of the functional and connector parts to another one of the functional and connector parts.

* * * * *

UNITED STATES PATENT AND TRADEMARK OFFICE

CERTIFICATE OF CORRECTION

PATENT NO. : 6,027,049
DATED : February 22, 2000
INVENTOR(S) : Hubert Stier

It is certified that error appears in the above-identified patent and that said Letters Patent is hereby corrected as shown below:

Column 1, line 41, after "invention," to -- delete ",".

Column 1, line 48, change "substantially an" to -- substantially includes an --.

Column 3, line 57, delete "to".

Column 4, line 10, delete "point".

Column 4, line 15, after "includes".

Column 6, line 9, delete "35".

Column 6, line 25, change "a" to --α--.

Signed and Sealed this

Eighth Day of May, 2001

*Attest:*

Nicholas P. Godici

NICHOLAS P. GODICI

*Attesting Officer*

*Acting Director of the United States Patent and Trademark Office*